US006170378B1

(12) United States Patent
Neal et al.

(10) Patent No.: US 6,170,378 B1
(45) Date of Patent: Jan. 9, 2001

(54) METHOD AND APPARATUS FOR DEFEATING HIGH-VELOCITY PROJECTILES

(75) Inventors: Murray L. Neal, 9196 Woodlawn Dr., Fresno, CA (US) 93720; Allan D. Bain, Oceanside, CA (US)

(73) Assignee: Murray L. Neal, Fresno, CA (US)

( * ) Notice: Under 35 U.S.C. 154(b), the term of this patent shall be extended for 0 days.

(21) Appl. No.: 09/189,105

(22) Filed: Nov. 9, 1998

(51) Int. Cl.[7] ..... A41D 13/00; F41H 1/02

(52) U.S. Cl. ..... 89/36.05; 2/2.5; 2/463; 2/464; 2/456; 428/98; 428/221; 428/573; 428/911; 156/256; 156/257; 29/464; 29/466

(58) Field of Search ..... 89/36.05; 2/2.5, 2/463, 464, 456; 428/98, 221, 573, 911; 156/256, 257; 29/464, 466

(56) References Cited

U.S. PATENT DOCUMENTS

| | | | | |
|---|---|---|---|---|
| 921,352 | | 5/1909 | Blaker et al. | 2/2.5 |
| 1,021,804 | | 4/1912 | Schneider | 2/2.5 |
| 1,282,411 | | 10/1918 | Golembiowski | 2/2.5 |
| 1,290,799 | | 1/1919 | Talley | 2/2.5 |
| 1,513,766 | | 11/1924 | Spooner | 2/2.5 |
| 1,739,112 | | 10/1929 | Wisbrod | 2/2.5 |
| 3,179,553 | | 4/1965 | Franklin | 161/183 |
| 3,563,836 | | 2/1971 | Dunbar | 161/38 |
| 3,577,836 | * | 5/1971 | Tamura | 89/36.05 |
| 3,813,281 | | 5/1974 | Burgess et al. | 161/1.59 |
| 3,829,899 | | 8/1974 | Davis | 2/2.5 |
| 3,867,239 | | 2/1975 | Alesi et al. | 161/37 |
| 4,648,136 | | 3/1987 | Higuchi | 2/2.5 |
| 5,196,252 | | 3/1993 | Harpell | 428/102 |
| 5,326,606 | | 7/1994 | Labock | 428/49 |
| 5,515,541 | | 5/1996 | Sacks et al. | 2/2.5 |
| 5,697,098 | * | 12/1997 | Miguel-Bettencourt et al. | 2/2.5 |

FOREIGN PATENT DOCUMENTS

| | | |
|---|---|---|
| 915345 | 1/1963 | (GB) . |
| WO 88/06413 | 9/1988 | (SE) . |
| WO 91/06823 | 5/1991 | (WO) . |

OTHER PUBLICATIONS

X–2 Promotional Materials, Alan Bain, Jan. 1996.

* cited by examiner

*Primary Examiner*—J. Woodrow Eldred
(74) *Attorney, Agent, or Firm*—Blakely, Sokoloff, Taylor and Zafman

(57) ABSTRACT

A method and apparatus for defeating high-velocity projectiles. A plurality of disks of equal size and having a thickness greater than 0.100" are milled in a plurality of places. Each milled place having a radius of curvature approximately equal to the radius of curvature of the disk. The disks are then laid out in an imbricated pattern row by row such that each disk in a row is in substantially a straight line with the other disks in the row and overlaps a milled place of a disk in a row above its row and has its milled place overlapped by a disk in the row below its row. The imbricated pattern is then adhered to a flexible, high tensile strength substrate and overlaid by a second high tensile strength layer such that the imbricated pattern is enveloped between the substrate and the second layer. The envelope is then coupled to a soft body armor backing.

19 Claims, 3 Drawing Sheets

METHOD AND APPARATUS FOR DEFEATING HIGH-VELOCITY PROJECTILES

BACKGROUND OF THE INVENTION (1) Field of the Invention

The invention relates to protective wear. More specifically, the invention relates to flexible body armor designed to defeat high-velocity projectiles.

(2) Background

Advances in body armor are frequently related to development of improved materials from which the armor is formed. In recent years, ballistic resistant materials formed from high tensile strength fibers, such as aramid fibers or polyethylene fibers, have gone into common use in the field. Unfortunately, soft body armor, even with these advanced materials, has proven insufficient to thwart even armor-piercing pistol ammunition, sharp thrusting implements, and circular penetrators, all of which are now in common use.

To address this problem, various hard metal plating systems have been developed. One such system employs a number of titanium discs one inch in diameter and 0.032–0.050 inches in thickness laid out in overlapping rows such that in the interior of a row, a disk overlaps its predecessor in the row and is overlapped by its successor in the row. Subsequent rows overlap their predecessor and are overlapped by their successor. The coin layout is then attached to a substrate such as adhesive impregnated aramid fabric. A second layer of adhesive impregnated aramid may be used to envelope the "plate" formed by the coins. This enveloped plate can be attached to conventional soft body armor over vital organs. It provides good flexibility and is thin enough to conceal.

While this overlapping of the coins has been shown to spread the force effectively to defeat most existing armor-piercing pistol rounds, sharp thrusting implements, and circular penetrators, unfortunately, rifle rounds continue to tear through this plating structure, as well as the underlying soft body armor like a hot knife through butter. Thus, for protection from rifle rounds, users have been required to employ large rigid plates to shield the vital organs. These large plates are heavy and inflexible, and generally uncomfortable to use. Additionally, they are next to impossible to use in a concealed manner. Efforts to employ the coin design with thicker disks have failed to yield a commercially viable product to defeat rifle rounds. Thicker disks result in less flexibility and do not lay out well. The result is a plating structure thicker, no more flexible, and heavier than the solid plates discussed above. Wearer comfort is also a premium concern in body armor production. Accordingly, these limitations make such a structure impractical as a commercial product.

In view of the foregoing, it would be desirable to have a flexible armoring system that would defeat high-velocity projectiles, such as rifle rounds.

BRIEF SUMMARY OF THE INVENTION

A method and apparatus for defeating high-velocity projectiles is disclosed. A plurality of disks of equal size and having a thickness greater than 0.100" are milled in a plurality of places. Each milled place having a radius of curvature approximately equal to the radius of curvature of the disk. The disks are then laid out in an imbricated pattern row by row such that each disk in a row is in substantially a straight line with the other disks in the row and overlaps a milled place of a disk in a row above its row and has its milled place overlapped by a disk in the row below its row. The imbricated pattern is then adhered to a flexible, high tensile strength substrate and overlaid by a second high tensile strength layer such that the imbricated pattern is enveloped between the substrate and the second layer. The envelope is then coupled to a soft body armor backing.

DETAILED DESCRIPTION OF THE INVENTION

Figure 1:
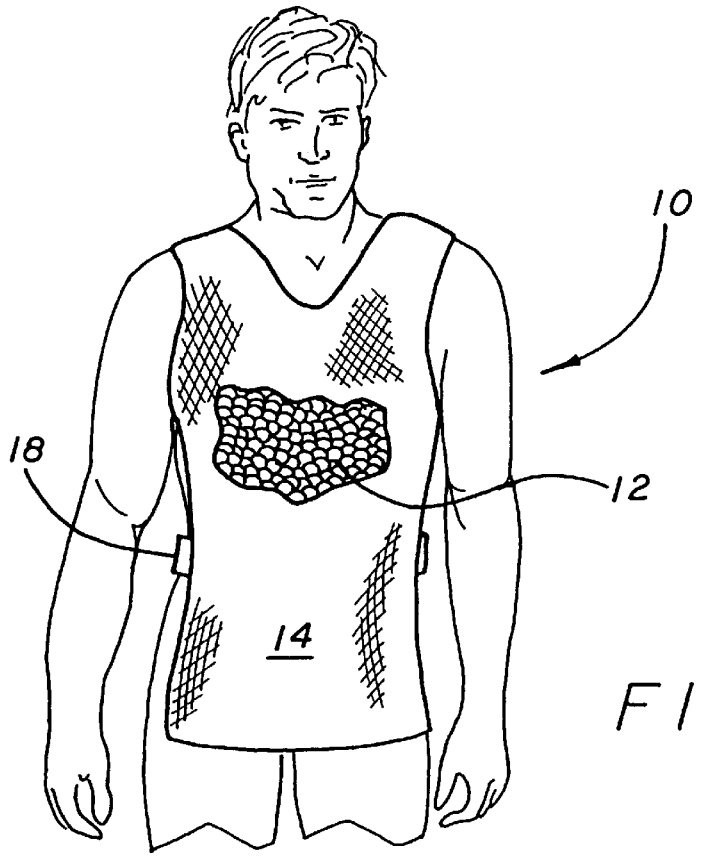
FIG. 1 is a cutaway schematic of a suit of body armor of one embodiment of the instant invention.

FIG. 1 is a cutaway schematic of a suit of body armor of one embodiment of the instant invention. The body armor 10 covers a user's torso and is designed to protect the vital areas from high-velocity projectiles. Through appropriately laying out disks in an imbricated pattern, the overall body armor 10 remains flexible and also provides good protection against high velocity projectiles. Unlike the 10×12 rigid plates of the prior art, the imbricated pattern can flex around body contours and is therefore considerably more comfortable and also more readily concealable. The imbricated pattern 12 is typically sandwiched between two layers of fabric 14 made of high tensile strength fibers, such as aramid fibers or polyethylene fibers. The fabric 14 should be tear and cut resistant and is preferrably ballistic grade material designed to reduce fragmentation. This fabric 14 can be adhesive impregnated, thus, the adhesive on the fabric adheres to the disks that compose the imbricated pattern 12 and retains their relative position. One or more additional layers of the fabric 14 may be added to the sandwich. This will be discussed further below.

Underlying the imbricated pattern 12 that is sandwiched between two or more layers of tear and cut resistant fabric layers 14 is conventional soft body armor 16. A high-velocity projectile is deemed defeated even if it penetrates the plating of the imbricated pattern and all fabric layers if it does not penetrate the underlying soft body armor or cause backside deformation of greater than 1.73", as backside deformation is defined by the National Institute of Justice (NIJ). Attachment straps, such as strap 18, couple a front panel of the body armor 10 to a back panel of the body armor 10 in a standard manner. Attachment strap 18 could be any conventional strapping common in the industry.

Figure 2:
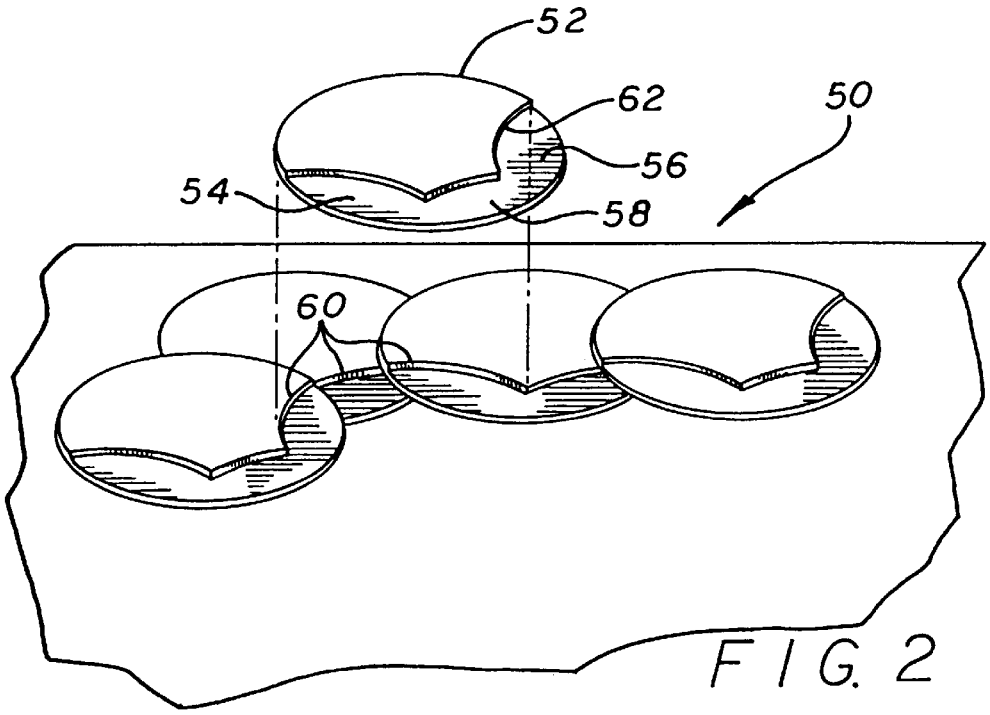
FIG. 2 is a perspective diagram of the layout of disks in one embodiment of the invention.

FIG. 2 is a perspective diagram of the layout of disks in one embodiment of the invention. In this case, the disks are laid out from left to right. Each subsequent row is also laid out left to right. It has been found that switching from left to right, then to right to left, creates weakness in the resulting pattern that often causes failure. FIG. 2 shows only part of two rows of the ultimate imbricated pattern. Disks within each row form a substantially straight line. Because the disks overlap, each disk has a slight slope relative a line normal to the layout surface. Additionally, each disk is rotated slightly such that a line through the center of a row in conjunction with an axis bisecting the milled arc of the central milled place is not at a right angle. In one embodiment, this angle is approximately 60°. A typical disk 52 is shown raised above its eventual placement in the pattern 50. Disk 52 is typically of a high hardness material, having a hardness of greater than 450 Brinell. Many suitable materials exist, including high carbon steel, stainless steel, steel alloys, and various titanium alloys. A preferred material is marketed under the trademark Mars 300™, and is available from Creusot-Loure Industries, a division of Creusot Marrel of France. Mars 300™ typically has a hardness of 630–650 Brinell. Another suitable material is sold under the trademark BP 633™ by Astralloy of Birmingham, Ala. Most suitable materials are sold in sheets. Mars 300™ is purchased in sheets having a thickness of approximately 0.168". The individual disks must be cut from the sheets. This can be accomplished by plasma cutting, laser cutting, or water jet cutting, depending on the material used. "Cutting" as used herein (when unmodified) refers generically to any technique by which a disk is produced.

In one embodiment, disk 52 is laser-cut using a conventional laser technology to ensure a uniform diameter and smooth edge as between multiple disks. Water jet cutting could be used but is not believed to be as good as laser cutting. Plasma cutting would also be possible but would then require additional deburring and smoothing steps to achieve the same edge smoothness. After cutting each disk 52 is milled, disk 52 is milled in three places—a left milled place 54, a central milled place 58, and a right milled place 56. This milling can be performed in any order.

In one embodiment, each milled place is milled in multiple passes. For example, the left milled place 54 is taken down to approximately half the eventual mill depth. The same half depth milling is then performed on the right milled place 56 followed by the central milled place 58. Then a second pass is performed to bring the mill depth down to approximately its final depth. A final high speed polishing pass is then performed to ensure a smooth finish for each of the milled places.

Typically, disk 52 has a radius between ½" and 2". Longer radii reduce flexibility but also manufacturing cost. In a currently preferred embodiment, a 1" radius is employed. Depending on the material, disks having thicknesses between 0.080" and 0.187" may be used. The radius of curvature of each milled place is approximately identical to the radius of the disk 52. Thus, if disk 52 has a one-inch radius, each milled place, left milled place 54, central milled place 58, and right milled place 56 also has a 1" radius of curvature. The depth of the milling is typically 0.040"–0.080" for disks between 0.100" and 0.187" in thickness.

Each milled place has a "mill distance." Mill distance is defined as used herein to be the perpendicular distance between the edge of disk 52 and the apex of the milled place 54, 56, 58. In one embodiment, the right and left milled places 54, 56 have the same mill distance which on a 1" radius disk is 0.540". The central milled place has a mill distance of 0.50 on a 1" radius disk. It is important that when laid out in the imbricated pattern, three disks so laid define an arc 60 into which an additional disk may be placed. Notably, a disk seated in arc 60 may only abut the milled edge 62 of the disks whose right and left milled place it overlays. This will depend on the depth of the milling. In one embodiment, the milled edge 62 has a slight slope as opposed to being exactly perpendicular to the milled surface. This reduces cracking of the disk during a ballistic event and reduces wear on the milling equipment.

While in one embodiment, all disks are identical to disk 52, this leads to a number of milled places along ending edges (e.g., the right edge and the bottom if a left to right layout is used or conversely, the left edge and bottom if a right to left layout is used). The pieces fit together neatly and there is no significant gap between overlapping disks. The overlap of the shown pattern has been found to effectively spread the force of a high-velocity projectile hit to adjacent disks, thereby preventing penetration and backside deformation. The edges on which disks have milled places not overlapped by another disk are deemed outside the "zone of protection" provided by the armor.

Additionally, because of the slight tilt of each disk in the pattern, a perpendicular hit is very unlikely and some of the energy will be absorbed in deflection. Finally, during the ballistic event, the hardness of the disk material tends to expand or blunt the tip of the projectile, causing a further reduction in its piercing ability. Notably, the layout can be made in any shape so that the zone of protection conforms to the torso or other vital area.

In an alternative embodiment, special finishing disks may be used with fewer milled places to ensure that all milled places are overlapped by a full thickness disk. For example, a bottom row of disks may be milled only to allow overlap of an adjacent disk in the bottom row, e.g., only having a right milled place (for a left to right layout), and since no other disk will overlap the disks in the bottom row, this will avoid thin spots in the bottom row.

Figure 3:
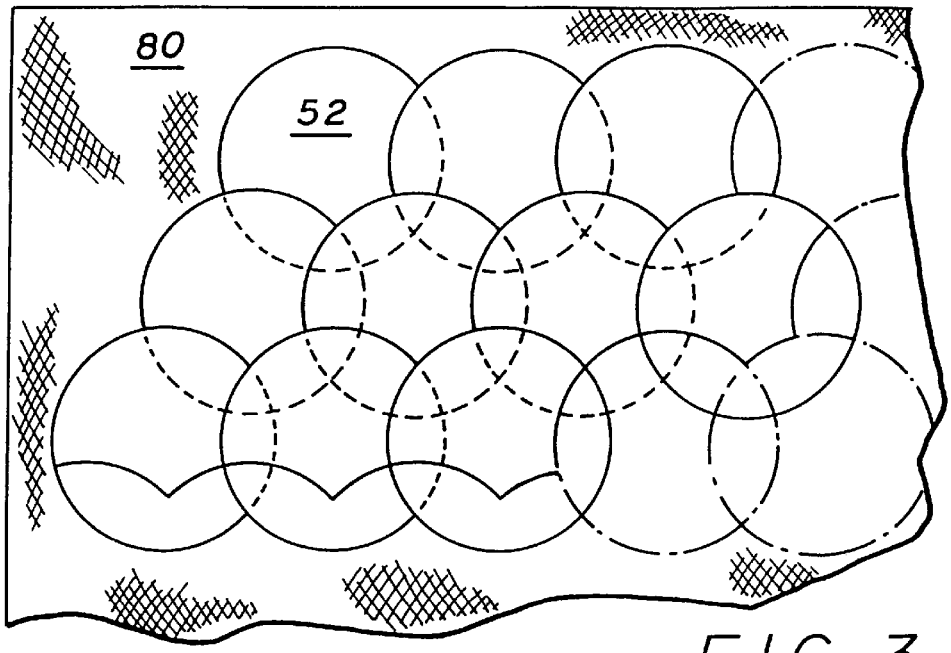
FIG. 3 is a diagram of an imbricated pattern adhered to a substrate.

FIG. 3 shows an imbricated pattern of disks 52 coupled to a substrate 80. As previously discussed, substrate 80 could be an adhesive impregnated polyethylene or aramid fiber fabric. Suitable fabrics include the fabric sold under the trademark SPECTRA® by AlliedSignal of Morristown, N.J., TWARON® microfiliment by Akzo-Nobel of Blacklawn, Ga., SB31 and SB2, sold under the trademark DYNEEMA, by DSM of Holland, PBO sold under the trademark ZYLON® by Toyobo of Tokyo, Japan, KEVLAR® or PROTERA® by E. I. Dupont de Nemours & Company of Chattanooga, Tenn. Other suitable fabrics will occur to one of ordinary skill in the art.

Some suitable substrates are available with an aggressive adhesive coating covered by a release paper. In addition to being aggressive, it is important that the adhesive once cured remains flexible to reduce separation of the disks and substrate during a ballistic event. The substrate of a desired size may be cut and the release paper peeled back to expose the adhesive surface. The disk can then be laid out directly onto the adhesive which retains them in position relative to one another. Because the substrate is flexible and the disks flex about their intersection, the combined unit is flexible. Alternatively, the pattern may be laid out and the substrate adhered over the top.

Figure 4:
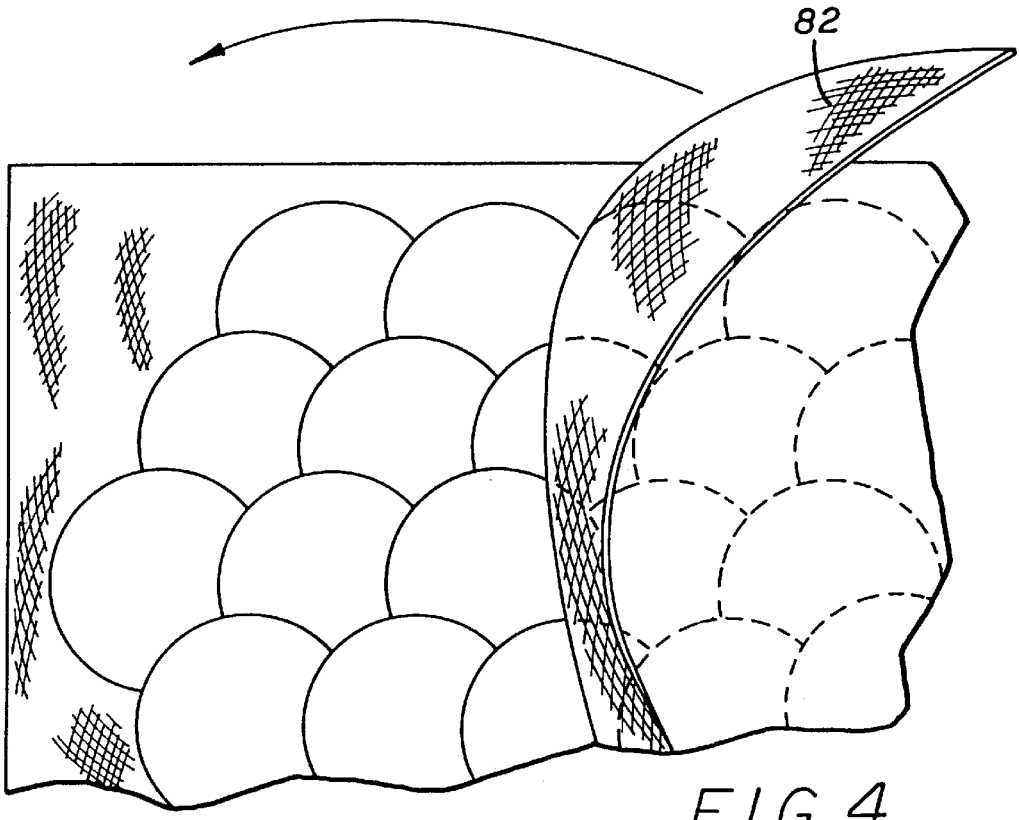
FIG. 4 is a diagram of enveloping the imbricated pattern between a substrate and an additional layer.

As shown in FIG. 4, the next step is to place another layer of this adhesive coated flexible substrate on the other side of the hand laid coins to secure them in a flexible position that does not change when the panel is flexed, such that although each coin will pivot off the adjacent coins, the actual position of each coin remains substantially in the same place it was laid. This second layer of adhesive fabric used to envelop the imbricated pattern provides further staying power, thereby reducing the risk that a disk will shift and the body armor will fail.

The NIJ defines various levels of threat. A level three threat is a full metal jacket 7.62×51 millimeter 150 grain round traveling at 2700–2800 feet/second. It has been found that the above-disclosed invention will defeat level three and all lesser threats. Additional layers of the adhesive coated flexible substrate material may be added to either side in any proportion (i.e. it is within the scope and contemplation of the invention to have more substrate layers on one side of the plate than the other side of the plate) in multiple layers to achieve different performance criteria. Some situations benefit from allowing the coins to move slightly during the ballistic event, while others make it desirable that the coin remain as secure in place as possible.

In an alternative embodiment of the invention, a "dry" high tensile strength flexible substrate is provided. It is then coated with a flexible bonding agent, for example, a silicon elastomer resin. The disks may then be laid out as described above. The bonding agent is then cured to flexibly retain the relative locations of the disks. A similarly coated layer can be used to sandwich the plate from the opposite side. It is also within the scope and contemplation of the invention to use one layer with a flexible bonding agent while a facing layer is of the peel and stick variety described above. As used herein, "adhesive impregnated substrate" refers to suitable flexible high tensile strength material having an adhesive disposed on one side, whether commercially available with adhesive in place or coated later as described above.

In yet another embodiment, an adhesive impregnated substrate is created by either above described method and the (sandwiching) layer is non-adhesive and merely coupled to the underlying substrate about the periphery of the plate. This will somewhat degrade the retension of the disk as compared to sandwiching between adhesive layers. Accordingly, this configuration will not survive as many hits and the front layer attached about the periphery serves primarily as a spall shield.

Figure 5:
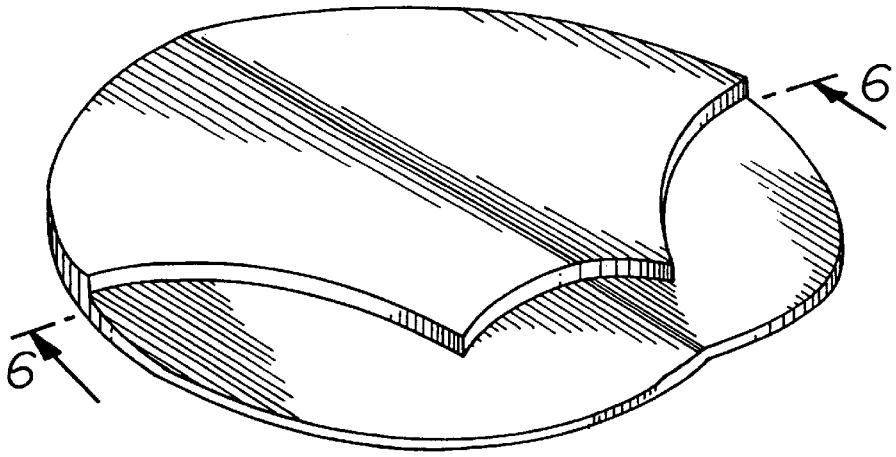
FIG. 5 is a perspective view of a disk of an alternative embodiment of the invention.
Figure 6:
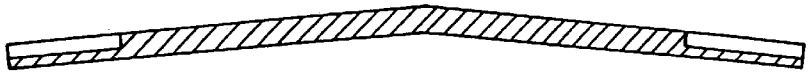
FIG. 6 is a sectional view of the disk of the embodiment of FIG. 5.

FIG. 5 is a perspective view of a disk of a second alternative embodiment of the invention. In this embodiment, a flat disk is prepared in the normal manner and then curved slightly about an axis bisecting the arc of the central milled place. The bend will typically range from 2° to 15° off the horizontal, depending on the dimensions and curvature of the area to be protected by the armor. This embodiment is most suitable where large disks, e.g., having a radius of 2", are used as the slight curve, allowing the disks to better match the contours of the body. This is desirable with large disks because the larger disks imply reduced flexibility of the overall assembly. Therefore, from a comfort standpoint, it is desirable to have a disk curved to accommodate body contour and motion. For disks of a radius 1" or less, such bending is deemed unnecessary and undesirable. FIG. 6 is a cross-sectional view of the disk of the embodiment of FIG. 5.

Figure 7:
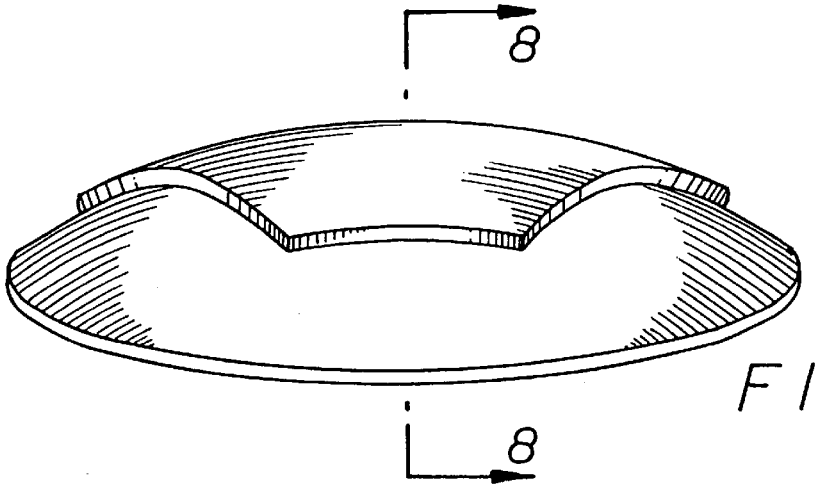
FIG. 7 is a perspective view of a disk of a second alternative embodiment of the invention.
Figure 8:
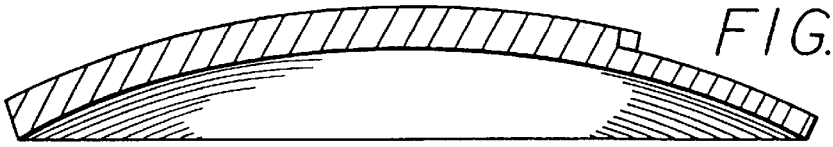
FIG. 8 is a cross-sectional view of the disk of the embodiment of FIG. 7.

FIG. 7 is a perspective view of a disk of an alternative embodiment of the invention. In this embodiment, the disk is prepared as described above. After milling but prior to layout, a press is used to concave the disk from the backside which causes the disk to be convex in the direction of the milled surface. FIG. 8 is a sectional view of the disk of the embodiment of FIG. 7. In this view, the concavity is clearly evident. This disk design may have improved deflection characteristics over the flat disk and also may improve comfort for some wearers.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. A method of making a body armor to defeat a high-velocity projectile, the method comprising:

providing a high hardness material sheet;

cutting a disk having a radius; and milling the disk in a plurality of places each having a radius of curvature equal to a radius of curvature of the disk.

2. The method of claim 1 wherein the sheet has a hardness greater than approximately 450 Brinell, and one disk a radius in the range of approximately ½" to approximately 2".

3. The method of claim 1 further comprising:

repeating the cutting and milling a plurality of times to produce a plurality of milled disks;

laying out the plurality of milled disks in an imbricated pattern; and adhering a high tensile strength substrate to a first side of the imbricated pattern.

4. The method of claim 3 wherein in the imbricated pattern a first disk of the plurality is overlapped by three additional disks of the plurality, one in each milled place such that each milled place is substantially entirely covered by a full thickness portion of the overlapping disk.

5. The method of claim 2 wherein the material sheet has a thickness in the range of approximately 0.100" to 0.187".

6. The method of claim 3 further comprising:

enveloping the imbricated pattern between the substrate and a second layer of flexible, high tensile strength material; and coupling the substrate and imbricated pattern to a soft body armor backing.

7. The method of claim 1 further comprising:

curving the disk about an axis intersecting a mill arc of one milled place.

8. The method of claim 1 further comprising:

pressing the disk to be convexed toward a surface including the milled places.

9. The method of claim 3 wherein laying out comprises:

placing a subset of the plurality of disks in a substantially straight row originating from a first direction with each disk rotated slightly such that an axis bisecting a central milled place is not at a 90° angle with a central axis of the row; and placing successive overlapping rows originating from the first direction.

10. An apparatus comprising:

a first disk of material having a hardness, the disk having a radius and a thickness, the disk milled in a plurality of places, each milled place having a radius of curvature approximately equal to the radius of the disk, each specific milled place having a mill distance from an apex of the milled arc to the edge of the disk.

11. The apparatus of claim 10 wherein the hardness is greater than 450 Brinell, the radius is in the range of 0.5" to 2", and the thickness is in the range of approximately 0.100" to 0.187".

12. The apparatus of claim 10 wherein the disk is approximately one inch in radius and the mill distance for a right milled and left milled place being approximately 0.54" and the mill distance for a central milled place being approximately 0.50".

13. The apparatus of claim 10 further comprising:

a plurality of additional disks substantially identical in dimension to the first disk; and a tear and cut resistant adhesive substrate adhering the disks in an imbricated pattern.

14. The apparatus of claim 13 wherein the plurality of milled places include a right milled place, a left milled place, and a central milled place, and wherein the imbricated pattern is such that a first disk is overlapped in the right milled place and left milled place by a second disk and a third disk, respectively, and the left milled place of the second disk and the, right milled place of the third disk defined in conjunction with the central milled place of the first disk an arc into which a fourth disk is seated, such that the fourth disk overlaps the central milled place of the first disk, the left milled place of the second disk, and the right milled place of the third disk.

15. The apparatus of claim 9 further comprising:

a soft body armor backing coupled to the substrate.

16. The apparatus of claim 13 wherein a 7.62×51 mm 150 grain full metal jacket projectile traveling 2700–2800 feet/second will not penetrate the soft body armor backing and causes less than 1.73" of backside deformation.

17. The apparatus of claim 10 wherein the disk is curved about an axis intersecting one milled arc.

18. The apparatus of claim 10 wherein the disk is convex in a direction of a surface containing the milled places.

19. The apparatus of claim 13 wherein a first subset of the plurality are arranged in a first row with each successive disk of the first subset overlapping a milled place of a preceding disk of the first subset and a second subset of the plurality are arranged in a second row such that the second row overlaps the first row and each successive disk of the subset overlaps a milled place and a preceding disk of the second subset and wherein the first row and second rows both originate from a same direction.

* * * * *